United States Patent [19]

Hess

[11] 4,421,299

[45] Dec. 20, 1983

[54] WINDOW CABLE DRIVING MECHANISM

[75] Inventor: Hans-Peter Hess, Coburg, Fed. Rep. of Germany

[73] Assignee: Metallwerk Max Brose GmbH & Co., Coburg, Fed. Rep. of Germany

[21] Appl. No.: 238,142

[22] Filed: Feb. 25, 1981

[30] Foreign Application Priority Data

Mar. 4, 1980 [DE] Fed. Rep. of Germany ..... 3008296

[51] Int. Cl.[3] ..... B66D 1/04; E05F 11/48

[52] U.S. Cl. ..... 254/342; 49/352

[58] Field of Search ..... 254/342, 343, 356, 901, 254/288, 269, 266, 373, 372, 403, 404, 383, 224, 230, 219; 49/352, 331; 242/129, 106, 107; 308/18, 37, 74; 16/29, 199, 212, 215

[56] References Cited

U.S. PATENT DOCUMENTS

| | | | |
|---|---|---|---|
| 476,101 | 5/1892 | Thomson | 254/344 X |
| 812,063 | 2/1906 | Merchant | 254/266 X |
| 815,586 | 3/1906 | Fuller et al. | 254/243 X |
| 1,024,434 | 4/1912 | Bishop | 242/107 |
| 1,175,581 | 3/1916 | Atwood | 74/506 |
| 1,552,697 | 9/1925 | Heintz | 49/352 X |
| 1,560,161 | 11/1925 | Hopkins | 254/342 X |
| 1,627,697 | 5/1927 | Fredericks | 49/352 |
| 1,651,003 | 11/1927 | Tichenor et al. | 49/352 X |
| 1,997,646 | 4/1935 | Miller | 49/352 X |
| 3,280,509 | 10/1966 | Werner | 49/352 |

FOREIGN PATENT DOCUMENTS

| | | | |
|---|---|---|---|
| 1908123 | 10/1962 | Fed. Rep. of Germany . | |
| 1928185 | 6/1969 | Fed. Rep. of Germany . | |
| 2441010 | 3/1975 | Fed. Rep. of Germany | 49/352 |
| 8854 | of 1906 | United Kingdom | 16/215 |
| 323380 | 1/1930 | United Kingdom | 49/352 |
| 631131 | 10/1949 | United Kingdom | 49/352 |
| 2029895 | 3/1980 | United Kingdom | 49/352 |

*Primary Examiner*—Philip R. Coe
*Assistant Examiner*—Frankie L. Stinson
*Attorney, Agent, or Firm*—Toren, McGeady and Stanger

[57] ABSTRACT

A window cable driving mechanism particularly for an automotive vehicle, including a base plate, a cable drum supported on one side of the base plate and a bracket extending about the cable drum attached with the base plate, is formed so that the bracket has defined thereon at least one bearing for the cable drum. Cylindrical rolling surfaces formed at axial ends of the cable drum include a cylindrical rolling surface facing away from the base plate. The bracket is constructed with at least one bearing surface which supports at least the cylindrical rolling surface facing away from the base plate.

4 Claims, 2 Drawing Figures

WINDOW CABLE DRIVING MECHANISM

The present invention relates generally to a driving mechanism which is especially useful in connection with the window of a motor vehicle. The device of the invention is of the type which utilizes a cable driving element and wherein a base plate is formed with a cable drum supported on one side thereof with a bracket which is attached to the base plate extending around the cable drum and forming at least one bearing for the cable drum.

In known driving mechanisms of this type, the cable drum is formed with a hub having axial ends which are supported in passages of a punched-out section of the base plate and the bracket.

The present invention is particularly directed toward a construction which will significantly simplify the arrangement of a mechanism of this type.

SUMMARY OF THE INVENTION

Briefly, the present invention may be defined as a window cable driving mechanism particularly for an automotive vehicle comprising a base plate, a cable drum supported on one side of said base plate, a bracket extending about said cable drum attached with said base plate, said bracket forming at least one bearing for the cable drum, and cylindrical rolling surfaces formed at axial ends of the cable drum including a cylindrical rolling surface facing away from the base plate, with at least said cylindrical rolling surface facing away from said base plate being supported by at least one bearing surface constructed at the bracket.

An important feature of the invention is that the cable drum is formed at its axial ends with cylindrical rolling surfaces of which at least that rolling surface facing away from the base plate is supported at at least one bearing surface constructed at the bracket.

In the driving mechanism of the invention, a hub for the cable drum may be omitted. The rolling surfaces of the cable drum may be directed radially outwardly or radially inwardly. The rolling surfaces are supported at bearing surfaces or sections of bearing surfaces which are formed by a working-out of the bracket or of the base plate.

The driving mechanism is preferably characterized such that the cable drum at its end facing the base plate has a rolling surface which is directed radially inwardly and supported at at least one bearing surface constructed at the base plate. Therefore, the end of the cable drum facing away from the base plate is supported at the bracket and the end of the cable drum facing the base plate is supported at the base plate itself. The bearing surfaces need not be of an annular configuration although this is occasionally advantageous. Rather, they are created by means of punched out lugs. The arrangement of a rolling surface in a circumferential groove in a front surface of the cable drum provides space-saving and protective features. For this purpose, one lateral wall only of the circumferential groove is constructed as a rolling surface.

In a preferred embodiment of the invention, a recess adapted to receive a cable nipple is constructed in the peripheral area of the cable drum close to one of its front surfaces in order to enable attachment of a cable to the cable drum.

The driving mechanism may be formed in an especially compact manner if the cable drum is annular and is provided at the inside thereof with a toothed configuration into which a pinion which is supported in the base plate and in the bracket may engage. This pinion is preferably supported in a passage formed in the bracket and/or in the base plate.

The cable drum is preferably driven by means of a coiled spring brake of the type known per se. For this purpose, the driving mechanism is preferably characterized such that on the side of the base plate facing away from the bracket there is attached a casing for the coiled spring brake within which there is supported the end, facing away from the base plate, of a crank bolt for the pinion, supported with its end, facing the base plate, in a central bore of the pinion.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENT

Figure 1A:
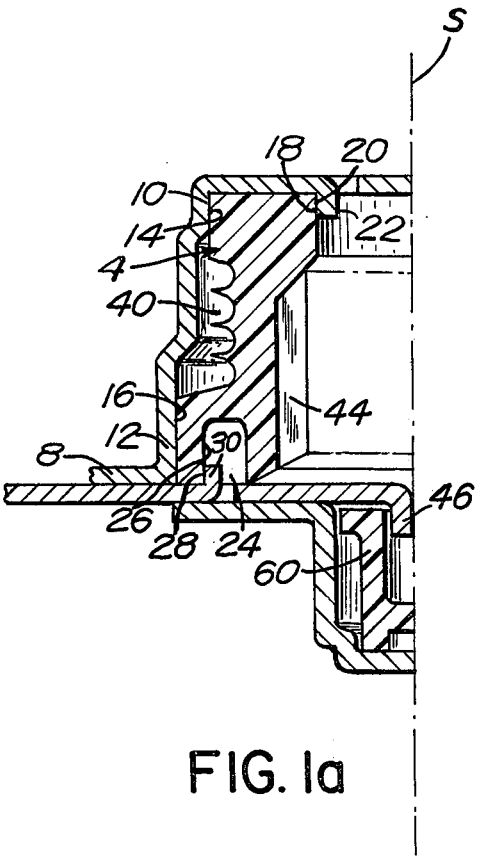
FIGS. 1*a* and 1*b* are, respectively, partial cross-sectional views of different embodiments of a mechanism in accordance with the present invention.
Figure 1B:
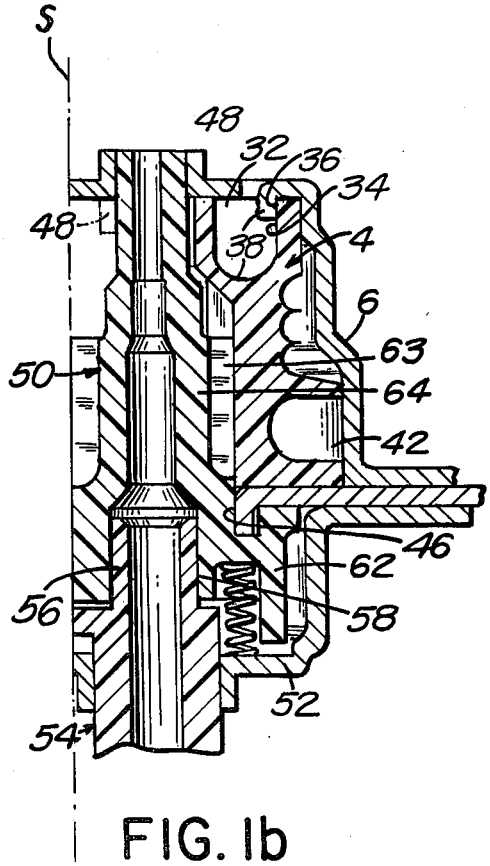

Referring now to the drawing, which is arranged so that a first embodiment of the driving mechanism is shown in FIG. 1*a* at the left of an axis of symmetry of the cable drum and wherein a second embodiment is shown in FIG. 1*b* at the right of the axis of symmetry of the cable drum, the driving mechanism of the invention is depicted as including a base plate 2 having a cable drum 4 supported at one side thereof. The cable drum 4 is enclosed by a bracket 6 (which can also be constructed as the casing) which is attached with an outer annular flange 8 at the base plate 2.

The cable drum 4, in the embodiment shown at the left of its line of symmetry S, is formed at its axial ends with cylindrical rolling surfaces 10, 12 which are supported at bearing surfaces 14, 16 of the bracket 6. Alternatively or additionally, the end of the cable drum 4 facing away from the base plate may also have a radially inwardly directed rolling surface 18 which is supported by a bearing surface 20 of the bracket 6. This bearing surface 20 is constructed by a tongue 22 which is punched out of the bracket 6 and bent.

In the front surface of the cable drum 4 facing the base plate 2, a circumferential groove 24 can be provided having a radial outer boundary wall 26 constructed as a rolling surface and supported by a bearing surface 28 at the base plate 2. The bearing surface 28 is formed as the surface of a lug 30 which is punched out of the base plate 2 and bent.

At the right of the line of symmetry S, there is shown an embodiment of the cable drum 4 which in its front surface facing away from the base plate has a circumferential groove 32 whose radially outer lateral wall is constructed as a rolling surface 34. The corresponding bearing surface 36 is located at a lug 38 which is punched out of the bracket 6 and bent.

The cable drum 4 is formed with cable grooves 40 between the axial ends of the drum 4. At its peripheral area adjacent the base plate 2, there is provided a recess 42 adapted to receive a cable nipple.

The cable drum 4 is of an annular construction and is provided at the interior thereof with a toothed configuration 44 into which a pinion 50 supported in passages 46 and 48 of the base plate 2 and the bracket 6 engages. The passage 48 is drawn outwardly. However, it may also be drawn inwardly, as indicated at 48'.

On the side of the base plate 2 facing away from the bracket 6 there is provided a casing 52 for a coiled spring brake (not shown). In the casing 52, the end of a crank bolt 54 facing away from the base plate 2 which drives the pinion 50 is supported. The end 56 of the crank bolt 54 facing the base plate 2 is supported in a central bore 58 of the pinion.

The pinion 50 and the crank bolt 54 are provided in a known manner with claws 60 and 62 acting on the coiled spring. The claws 60 and 62 can be installed in a fixed manner at the pinion 50 and the crank bolt 54. The looped or coiled spring, known per se, is located between the claws 60 and 62 and the inner wall of the casing 52.

The actual pinion formed by the outer toothed construction 63 and the inherent core 64 is constructed in the present case in a unitary manner as a single piece with its carrier which as a pinion pin is supported in the passages 48 and 46. However, such a one-piece construction is not necessary.

The bracket 6 may consist of a deformed sheet metal part or of an injection molded part of plastic and/or metal.

The interaction of the pinion and the crank bolt and the type of support according to the embodiment are especially advantageous in view of the distribution of forces to be absorbed by individual bearings.

Passages (not shown) for a cable are provided at the bracket 6 if a specified direction is to be imparted to the cable after it leaves the bracket 6. Then, suitable flanges may be installed or formed on the bracket 6 which will act like a nozzle and steer the cable in a specified direction.

In the known embodiments, the suspension point of the cable nipple usually lies in the radial direction between the drum axis S and the grooves 40. Suspension of the cable nipple in the recess 42 axially adjacent the cable grooves 40 provides good space-saving features.

While specific embodiments of the invention have been shown and described in detail to illustrate the application of the inventive principles, it will be understood that the invention may be embodied otherwise without departing from such principles.

What is claimed is:

1. A window cable driving mechanism particularly for a motor vehicle comprising: a base plate; a cable drum supported at one side of said base plate, said cable drum having an annular configuration with a hollow internal portion provided with a toothed construction; pinion means located in said hollow internal portion engaging in said toothed construction of said cable drum; crank bolt means connected to drive said pinion means; coiled spring brake means located at the side of said base plate opposite said cable drum connecting said crank bolt in driving engagement with said pinion means to drive said cable drum through said pinion means; bracket means attached on said base plate enclosing said cable drum; lug means bent to extend from said bracket means for defining supporting bearing surface means at which said cable drum is rotatably supported, said cable drum further comprising rolling surface means extending parallel to the axial direction of said cable drum for engaging said bearing surface means to rotatably support said cable drum in said driving mechanism; housing means fastened to said base plate on a side thereof opposite said one side, said housing means having said coiled spring brake means located therein; said pinion means extending through said cable drum and being supported at one end thereof on said bracket means and at an opposite end thereof on said base plate, with a centrally located internal bore being provided in said pinion means at said opposite end; said crank bolt means being supported in said housing and extending interiorly thereof into supported engagement in said internal bore of said pinion means.

2. A mechanism according to claim 1 wherein said cable drum has at an end thereof facing said base plate a radially inwardly directed rolling surface which is supported at least at one bearing surface constructed at said base plate.

3. A mechanism according to claim 1 wherein said cable drum has in at least one of its front surfaces a circumferential groove having a lateral sidewall constructed as said rolling surface.

4. A mechanism according to claim 1 wherein said cable drum is formed in a peripheral area thereof adjacent one of its front surfaces with a recess adapted to receive a cable nipple.

* * * * *